US009215757B2

(12) United States Patent
Wu

(10) Patent No.: US 9,215,757 B2
(45) Date of Patent: Dec. 15, 2015

(54) TEMPERATURE CONTROLLER OF A HEATING PLATE

(71) Applicant: Yin-Chiang Wu, Taichung (TW)

(72) Inventor: Yin-Chiang Wu, Taichung (TW)

( * ) Notice: Subject to any disclaimer, the term of this patent is extended or adjusted under 35 U.S.C. 154(b) by 0 days.

(21) Appl. No.: 14/264,079

(22) Filed: Apr. 29, 2014

(65) Prior Publication Data

US 2015/0181648 A1 Jun. 25, 2015

(30) Foreign Application Priority Data

Dec. 20, 2013 (TW) ..... 102147357 A

(51) Int. Cl.
*H05B 1/02* (2006.01)
*H05B 3/20* (2006.01)

(52) U.S. Cl.
CPC ... *H05B 1/02* (2013.01); *H05B 3/20* (2013.01)

(58) Field of Classification Search
CPC ..... H05B 1/02; H05B 1/0233; H05B 1/025; H05B 3/0047; H05B 3/0071
USPC ..... 219/490, 494, 497, 501, 209, 210
See application file for complete search history.

(56) References Cited

U.S. PATENT DOCUMENTS

| | | | | |
|---|---|---|---|---|
| 5,309,090 | A * | 5/1994 | Lipp | 324/750.03 |
| 5,798,667 | A * | 8/1998 | Herbert | 327/573 |
| 6,329,642 | B1 * | 12/2001 | Kaneko et al. | 219/497 |
| 6,433,567 | B1 * | 8/2002 | Okayasu | 324/750.03 |
| 6,861,860 | B2 * | 3/2005 | Maggi et al. | 324/750.05 |
| 7,619,427 | B2 * | 11/2009 | Ando et al. | 324/750.13 |
| 8,093,535 | B2 * | 1/2012 | Heismann et al. | 219/494 |
| 8,274,301 | B2 * | 9/2012 | Feng et al. | 324/750.03 |
| 8,927,909 | B2 * | 1/2015 | Le Neel et al. | 219/494 |
| 2011/0063344 | A1 * | 3/2011 | Satoh et al. | 347/7 |

* cited by examiner

*Primary Examiner* — Mark Paschall

(57) ABSTRACT

A miniature temperature control structure for an electric heating piece contains a miniature temperature controller. The miniature temperature controller includes a circuit board on which a plurality of electronic parts are arranged, and the plurality of electronic parts at least has a microprocessor and an electrical contact portion disposed on the circuit board, the microprocessor has a thermostat program for setting a temperature value of each of a starting heating and a stopping heating based on requirement of an electric heating piece and for setting a heating time or a heating cycle time of the electric heating piece. Thereby, a size of the circuit board of the miniature temperature controller is decreased greatly to lower production cost of the electric heating piece and to carry the electric heating piece easily.

3 Claims, 8 Drawing Sheets

TEMPERATURE CONTROLLER OF A HEATING PLATE

FIELD OF THE INVENTION

The present invention relates to a miniature temperature control structure for an electric heating piece which miniaturizes a size of a circuit board of a miniature temperature controller to lower production cost of the electric heating piece and to carry the electric heating piece easily.

BACKGROUND OF THE INVENTION

With reference to FIG. 10, a conventional electric heating piece contains a control unit 11 for outputting electric current, a body 12, and an adjusting unit 13 for electrically connecting with the control unit 11, a first guiding wire 14 for electrically connecting with the control unit 11 and the adjusting unit 13, and a second guiding wire 15 for electrically connecting with the adjusting unit 13 and the body 12. The control unit 11 has a power supply 111 for accommodating a battery and supplying electric current from the control unit 11.

However, the conventional electric heating piece still has the following defects:

1. The control unit has plural adjustable buttons arranged thereon, so it has cannot be miniaturized in a small size.

2. A temperature and a heating time can only be set within a limited range, thus limiting heating temperature and time.

The present invention has arisen to mitigate and/or obviate the afore-described disadvantages.

SUMMARY OF THE INVENTION

The primary objective of the present invention is to provide a miniature temperature control structure for an electric heating piece which miniaturizes a size of a circuit board of a miniature temperature controller to lower production cost of the electric heating piece and to carry the electric heating piece easily.

To obtain the above objectives, a miniature temperature control structure for an electric heating piece provided by the present invention contains a miniature temperature controller.

The miniature temperature controller includes a circuit board on which a plurality of electronic parts are arranged, and the plurality of electronic parts at least has a microprocessor and an electrical contact portion disposed on the circuit board, the microprocessor has a thermostat program for setting a temperature value of each of a starting heating and a stopping heating based on requirement of an electric heating piece and for setting a heating time or a heating cycle time of the electric heating piece.

DETAILED DESCRIPTION OF THE PREFERRED EMBODIMENTS

With reference to FIGS. 1 to 10, a miniature temperature control structure for an electric heating piece according to a first embodiment of the present invention comprises an electric heating piece 10, a miniature temperature controller 20, and an adjusting device 30.

The electric heating piece 10 converts an electric energy into heat energy, since it is a well-known prior art, further remarks are omitted.

Figure 1:
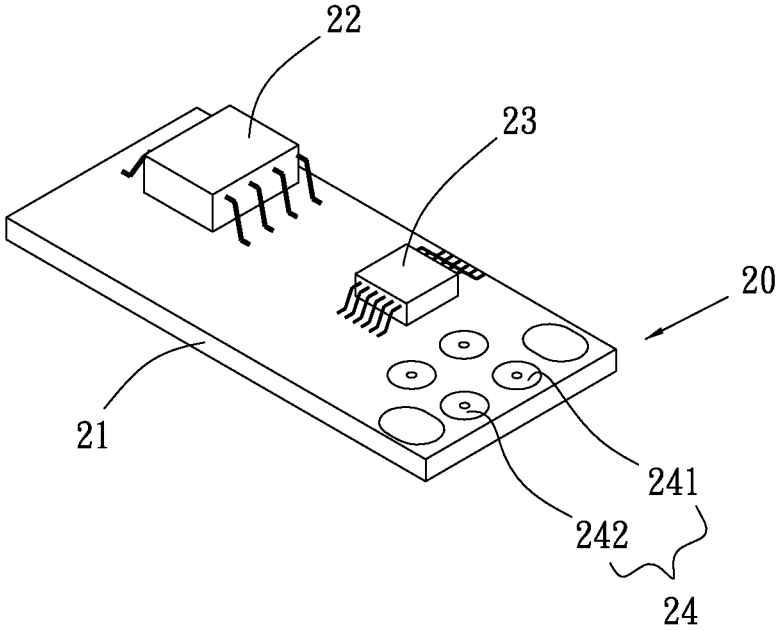
FIG. 1 is a perspective view showing the assembly of a miniature temperature controller of a miniature temperature control structure for an electric heating piece according to a first embodiment of the present invention.
Figure 2:
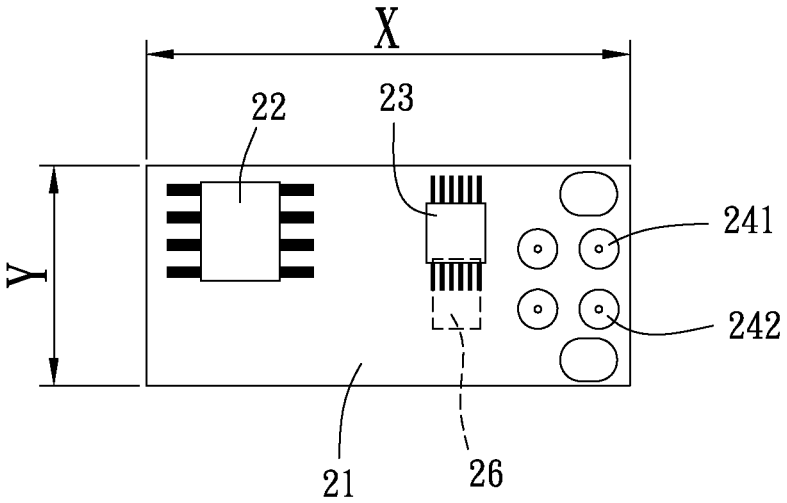
FIG. 2 is a plane view showing the assembly of the miniature temperature controller of the miniature temperature control structure for the electric heating piece according to the first embodiment of the present invention.
Figure 3:
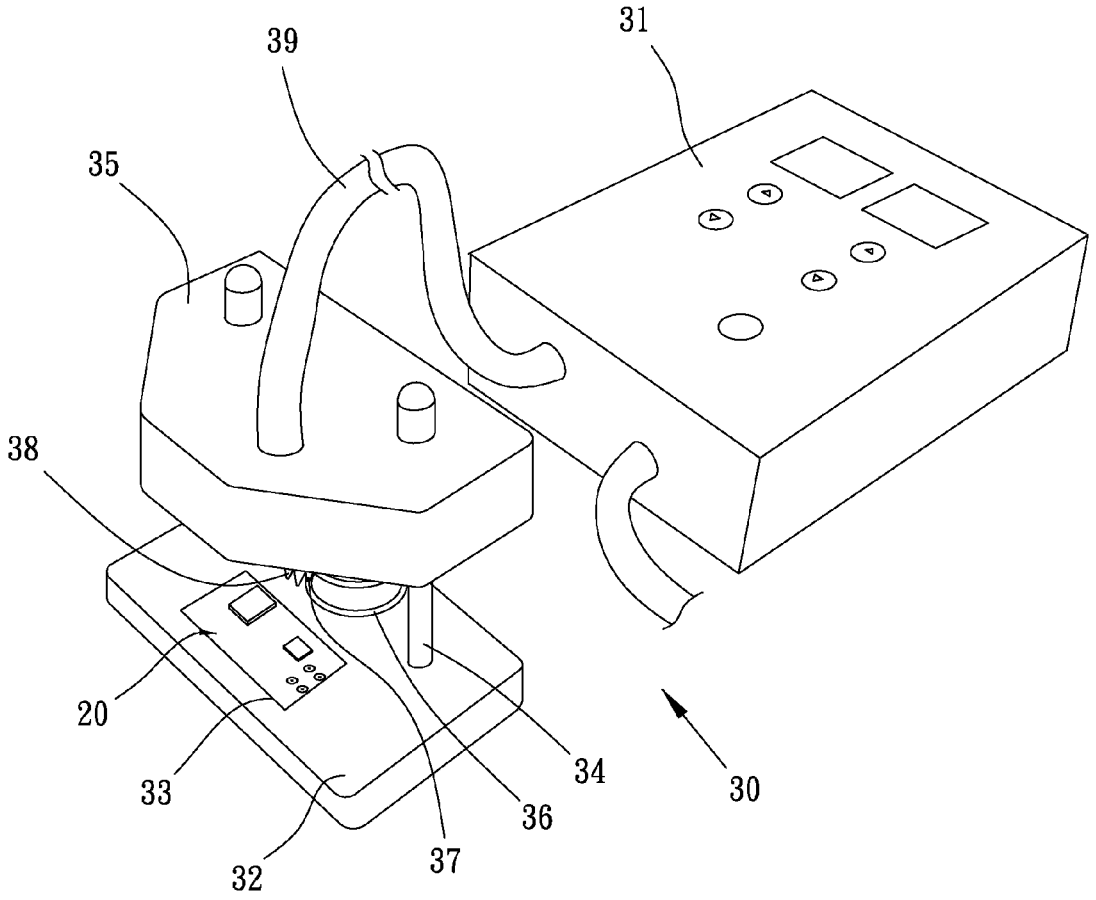
FIG. 3 is a perspective view of an adjusting device of the miniature temperature control structure for the electric heating piece according to the first embodiment of the present invention.
Figure 5:
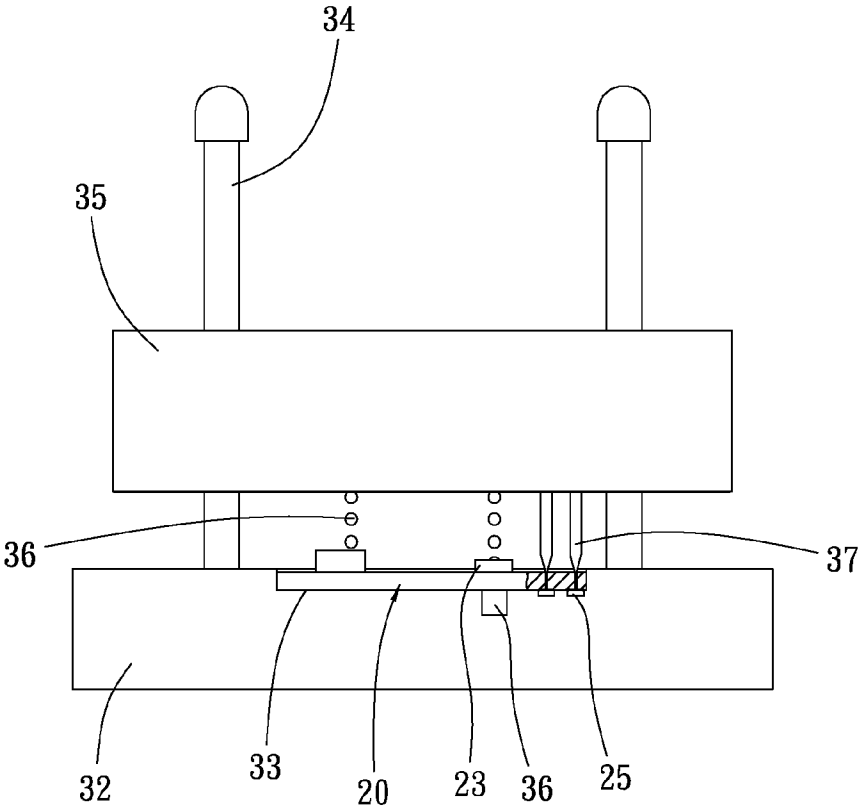
FIG. 5 is another plane view showing the operation of the adjusting device of the miniature temperature control structure for the electric heating piece according to the first embodiment of the present invention.
Figure 4:
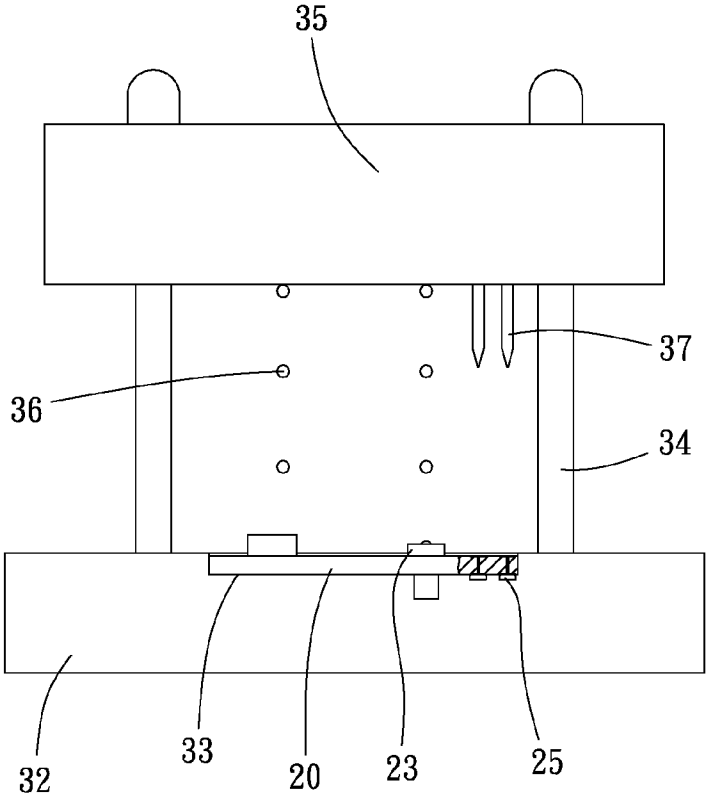
FIG. 4 is a plane view showing the operation of the adjusting device of the miniature temperature control structure for the electric heating piece according to the first embodiment of the present invention.
Figure 6:
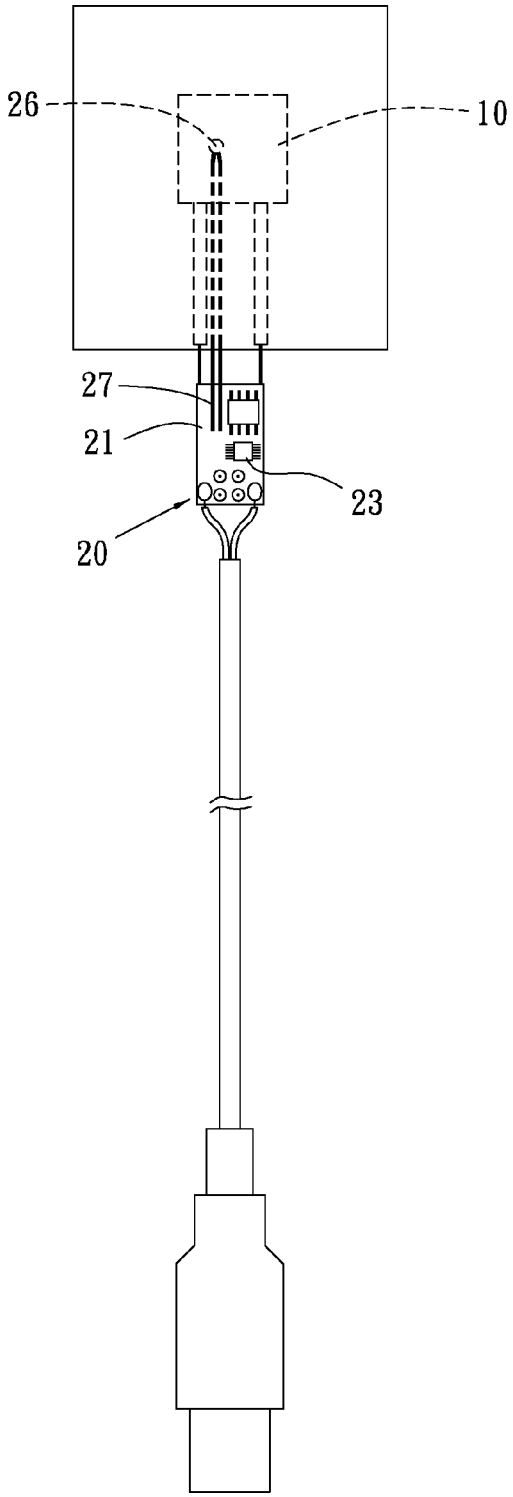
FIG. 6 is a plane view showing the application of the miniature temperature controller of the miniature temperature control structure for the electric heating piece according to the first embodiment of the present invention.
Figure 7:
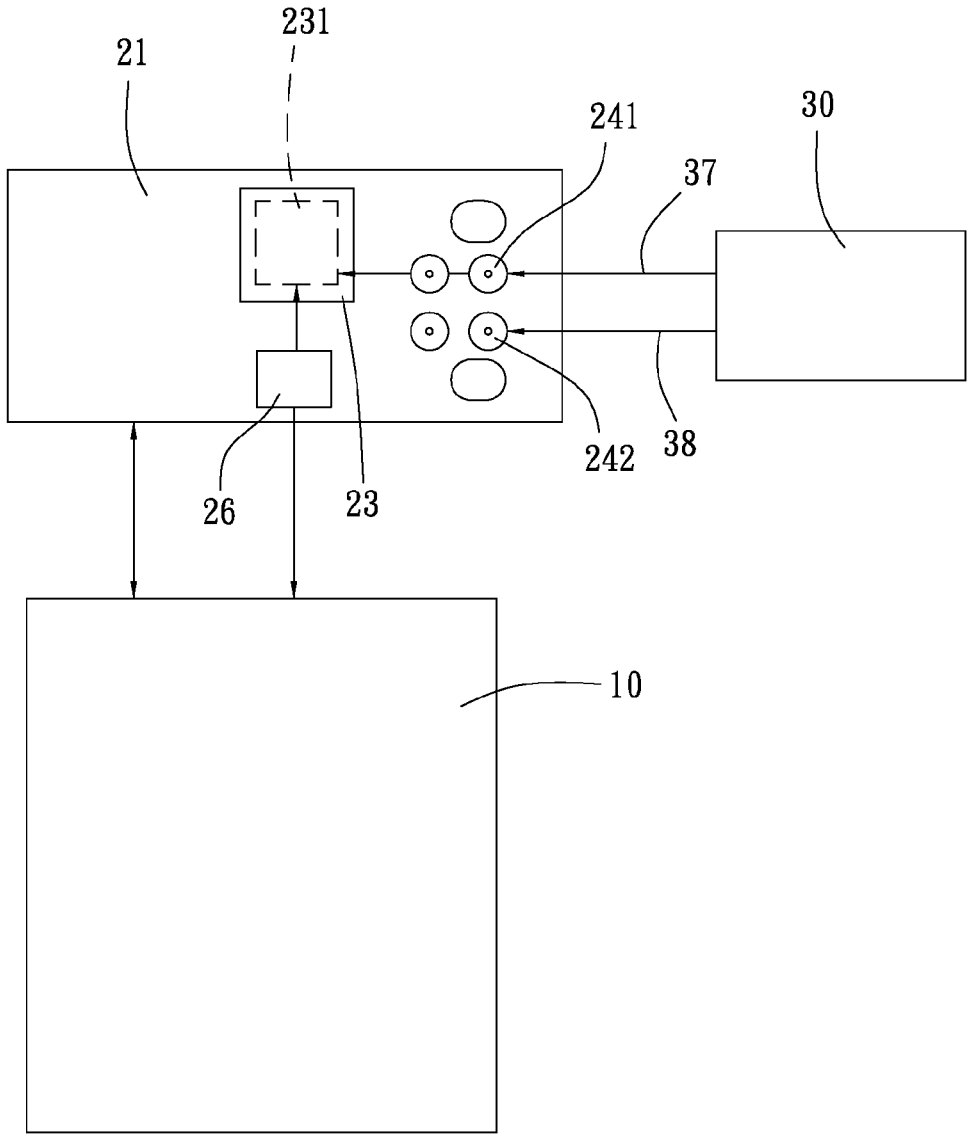
FIG. 7 is a block diagram showing the operation of the adjusting device of the miniature temperature control structure for the electric heating piece according to the first embodiment of the present invention.

The miniature temperature controller 20 includes a circuit board 21 on which a plurality of electronic parts 22 are arranged, and a length of the circuit board 21 is within 10 to 28 mm, a width of the circuit board 21 is within 6 to 20 mm. The plurality of electronic parts 22 at least has a microprocessor 23, a temperature sensing element 26, and an electrical contact portion 24 disposed on the circuit board 21; the microprocessor 23 has a thermostat program 231 for setting a temperature value of each of a starting heating and a stopping heating based on requirement of the electric heating piece 10 and for setting a heating time or a heating cycle time of the electric heating piece. The temperature sensing element 26 is provided to sense a temperature resulting from the electric heating piece 10 and to feedback a sensed temperature to the microprocessor 23. The temperature sensing element 26 is arranged on the circuit board 21 and is designed in at least two types. For example, as shown in FIGS. 2 and 5, the temperature sensing element 26 is arranged on and connected with the circuit board 21 and contacts with the electric heating piece 10 directly. As illustrated in FIGS. 2 to 6, the temperature sensing element 26 is separated from the circuit board 21, and a circuit wire 27 is provided to connect the temperature sensing element 26 and the circuit board 21 together. The thermostat program 231 of the microprocessor 23 is employed to set the temperature value repeatedly by ways of the adjusting device 30. The electrical contact portion 24 has two signal pins 241 and two power supply pins 242 adjacent to the two signal pins 241, and each signal pin 241 has a resistance element 25 fixed thereon to increase impedance and to maintain a high potential state, thereby stabilizing signal.

The adjusting device 30 includes an adjustable controller 31, a base 32, an accommodation portion 33, two guiding rods 34, a movable plate 35, and a resilient member 36.

The adjustable controller 31 is an electronic apparatus with setting functions, such as setting an on/off temperature value, a heating time, etc. The accommodation portion 33 receives the miniature temperature controller 20, and the two guiding rods 34 extend outwardly from the base 32, the movable plate 35 is slidably fitted onto the two guiding rods 34, and the resilient element 36 are defined between the movable plate 35 and the base 32 so that the movable plate 35 slides along the two guiding rods 34.

The adjusting device 30 includes a signal connecting segment 37 and a power connecting segment 38 which correspond to an upper side (or a lower side) of the electrical contact portion 24 of the miniature temperature controller 20, and the signal connecting segment 37 and the power connecting end 38 are electrically connected with the adjustable controller 31 via a signal cable 39. In this embodiment, the signal connecting segment 37 and the power connecting segment 38 are mounted on a bottom end of the movable plate 35 opposite to the electrical contact portion 24 of the miniature temperature controller 20, and the signal cable 39 extends to the adjustable controller 31 from the movable plate 35.

As desiring to reset a temperature control function set by the thermostat program 231, the adjustable controller 31 sets a value of the temperature control function (such as an on/off temperature value or the heating cycle time), and the miniature temperature controller 20 is placed in the accommodation portion 33, the movable plate 35 is pressed so that the signal connecting segment 37 and the power connecting segment 38 electrically connect with the two signal pins 241 and the two power supply pins 242, thereby resetting the temperature control function.

Figure 8:
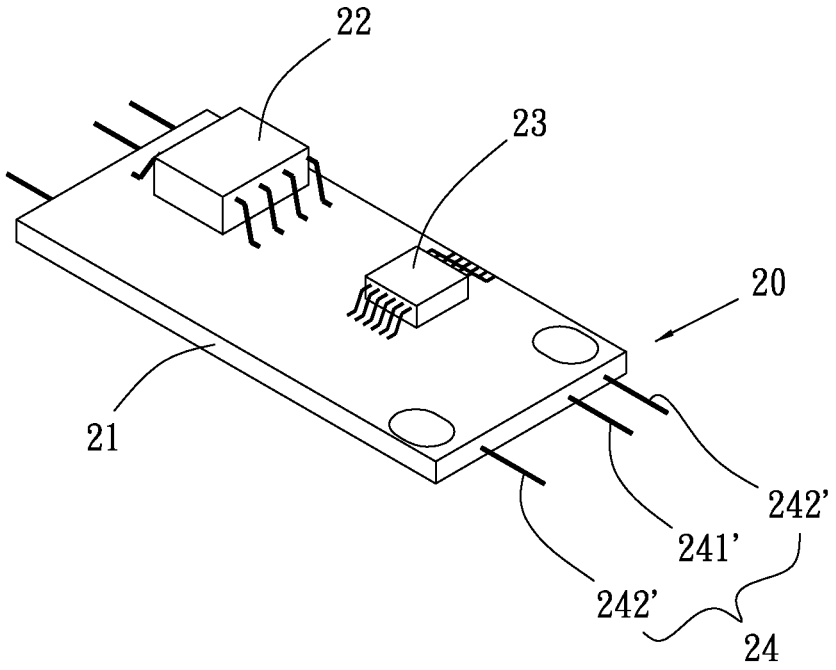
FIG. 8 is a perspective view showing the assembly of a miniature temperature controller of a miniature temperature control structure for an electric heating piece according to a second embodiment of the present invention.
Figure 9:
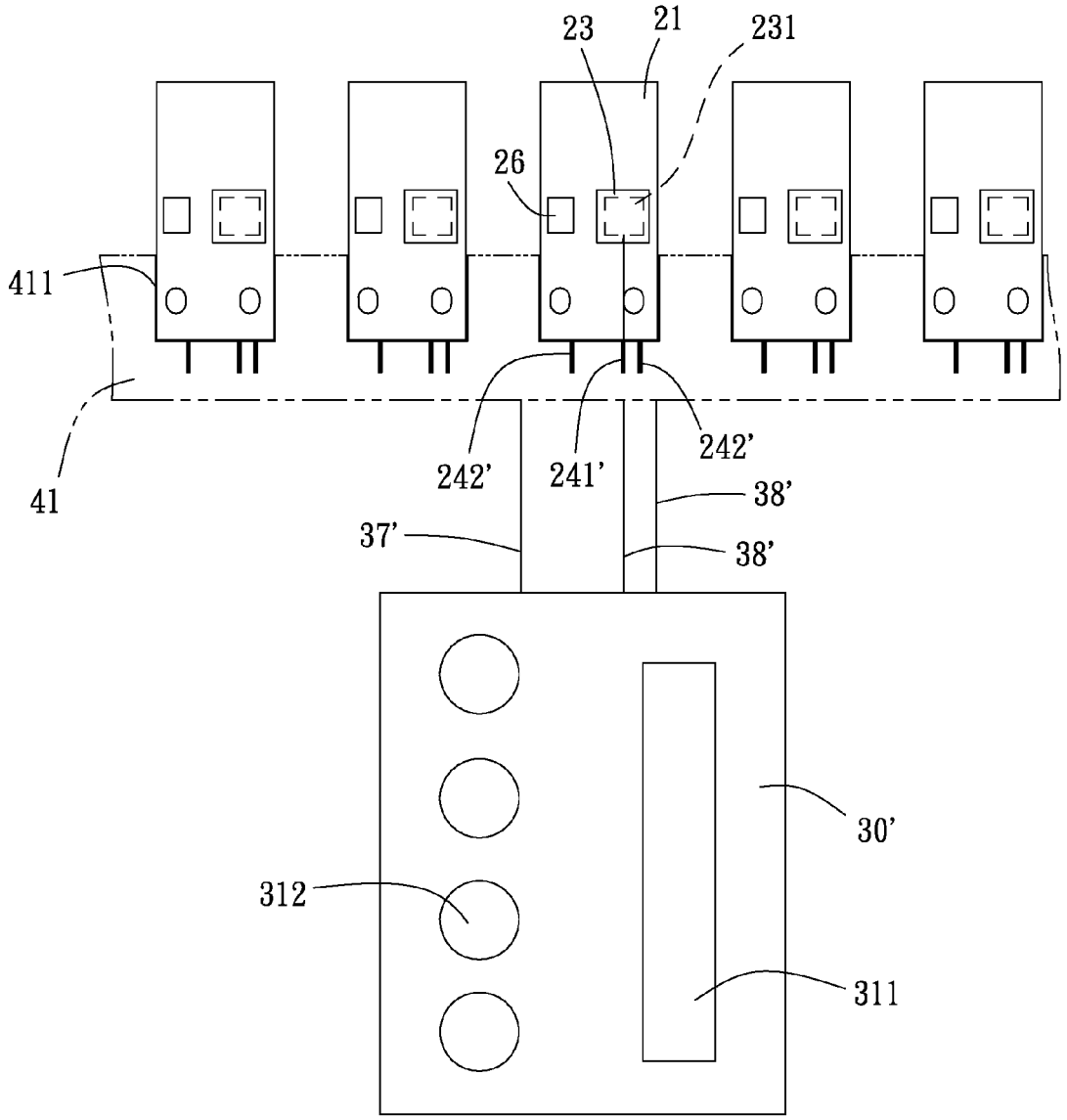
FIG. 9 is a plane view showing the operation of the miniature temperature controller of the miniature temperature control structure for the electric heating piece according to the second embodiment of the present invention.
Figure 10:
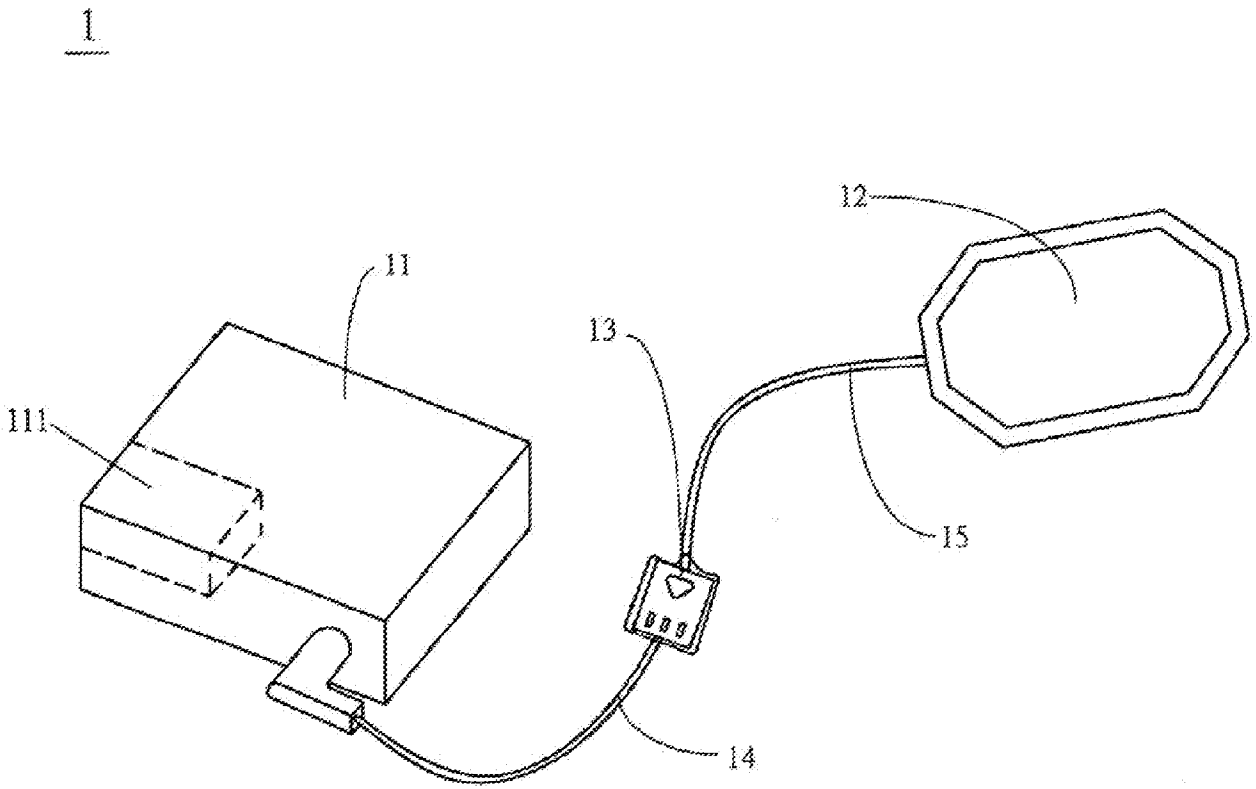
PRIOR ART FIG. 10
FIG. 10 is a perspective view of a conventional electric heating piece.

Referring further to FIGS. 8 and 9, a miniature temperature control structure for an electric heating piece according to a second embodiment of the present invention comprises a miniature temperature controller 20 including a signal pin 241' and two power pins 242'; an adjusting device 30' including a socket 41 and an adjustable controller 31'; wherein the socket 41 has a plurality of slots 411 for accommodating one end of an electrical contact portion 24 of a miniature temperature controller 20 so that the plurality of slots 411 electrically connect with the electrical contact portion 24. The adjustable controller 31' includes a screen 311 and plural controlling buttons 312 and electrically connects with the socket 41 by using of a signal connecting segment 37' and two power connecting segments 38', such that the adjusting device 30' resets a thermostat program to control an electric heating piece so as to set a temperature value of each of starting heating and stopping heating or to set a heating time.

Thereby, the circuit board 21 of the miniature temperature controller 20 is miniaturized to lower production cost of the electric heating piece and to carry the electric heating piece easily.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A miniature temperature control structure for an electric heating piece comprising:

a miniature temperature controller including a circuit board on which a plurality of electronic parts are arranged, characterized in that:

the plurality of electronic parts at least has a microprocessor and an electrical contact portion disposed on the circuit board, the microprocessor has a thermostat program for setting a temperature value of each of a starting heating and a stopping heating based on requirement of an electric heating piece and for setting a heating time or a heating cycle time of the electric heating piece;

wherein the electrical contact portion of the miniature temperature controller has two signal pins and two power supply pins for electrically connecting with a signal connecting segment and a power connecting segment of the adjusting device, the adjusting device includes an adjustable controller and an accommodation portion, the adjustable controller sets an on/off temperature value and a heating time, and the accommodation portion receives the miniature temperature controller, and the signal connecting segment and the power connecting segment of the adjusting device correspond to one side of the electrical contact portion of the miniature temperature controller.

2. The miniature temperature control structure for the electric heating piece as claimed in claim 1, wherein the adjusting device includes a base, two guiding rods extending outwardly from the base, and a movable plate slidably fitted onto the two guiding rods, and a resilient member defined between the movable plate and the base.

3. A miniature temperature control structure for an electric heating piece comprising:

a miniature temperature controller including a circuit board on which a plurality of electronic parts are arranged, characterized in that:

the plurality of electronic parts at least has a microprocessor and an electrical contact portion disposed on the circuit board, the microprocessor has a thermostat program for setting a temperature value of each of a starting heating and a stopping heating based on requirement of an electric heating piece and for setting a heating time or a heating cycle time of the electric heating piece;

wherein the miniature temperature controller includes a signal pin and two power pins for electrically connecting with a signal connecting segment and a power connecting segment of an adjusting device; the adjusting device also includes a socket and an adjustable controller; the socket has a plurality of slots for accommodating one end of the electrical contact portion of the miniature temperature controller so that the plurality of slots electrically connect with the electrical contact portion; the adjustable controller includes a screen and plural controlling buttons and electrically connects with the socket by using of the signal connecting segment and the two power connecting segments.

* * * * *